US005369969A

United States Patent [19]

Sassella et al.

[11] Patent Number: 5,369,969

[45] Date of Patent: Dec. 6, 1994

[54] DOOR HANDLE WITH LOCK HOUSING

[75] Inventors: Christopher D. Sassella, Lower Plenty; Gerrard Mussett, Elwood; Paul Taylor, Doncaster, all of Australia

[73] Assignee: Dowell Australia Limited, Preston, Australia

[21] Appl. No.: 18,718

[22] Filed: Feb. 17, 1993

[30] Foreign Application Priority Data

Apr. 21, 1992 [AU] Australia ..... PL1983

[51] Int. Cl.[5] ..... E05B 65/08

[52] U.S. Cl. ..... 70/90; 70/95; 70/99; 70/224; 70/432; 292/347

[58] Field of Search ..... 70/95, 99, 100, 432, 70/DIG. 60, DIG. 8, 224, 90, 96–98, 207; 292/347, DIG. 46

[56] References Cited

U.S. PATENT DOCUMENTS

| | | | |
|---|---|---|---|
| 1,662,773 | 3/1928 | Albach | 70/207 |
| 1,894,913 | 1/1933 | Sadler | 292/DIG. 46 X |
| 2,784,993 | 3/1957 | Collar | 70/432 |
| 3,046,776 | 7/1962 | Marotto et al. | 70/97 |
| 3,118,298 | 1/1964 | Holmes | 70/100 |
| 3,216,229 | 11/1965 | Moncada | 70/100 |
| 3,353,855 | 11/1967 | Smith | 70/95 |
| 3,368,374 | 2/1968 | Eads | 70/370 |
| 3,563,068 | 2/1971 | Dushane, Jr. | 70/100 |
| 4,663,949 | 5/1987 | Yane | 70/100 |
| 4,698,989 | 10/1987 | Zuckerman | 70/DIG. 60 X |
| 4,754,624 | 7/1988 | Fleming et al. | 70/99 X |
| 4,790,157 | 12/1988 | Lin | 70/100 X |
| 5,092,144 | 3/1992 | Fleming et al. | 70/100 X |

FOREIGN PATENT DOCUMENTS

| | | | |
|---|---|---|---|
| 1439814 | 4/1966 | France | 70/100 |
| 2945507 | 5/1981 | Germany | 70/95 |
| 1240856 | 6/1986 | U.S.S.R. | 70/100 |

*Primary Examiner*—Lloyd A. Gall
*Attorney, Agent, or Firm*—Foley & Lardner

[57] ABSTRACT

A door handle and lock body housing combination is provided. The lock body housing (1) has a rectangular shaped base configuration (5) which has a length approximately equal to the length of a handle (3) which extends therefrom in a direction generally parallel to the planar base (5). The height and width of the lock body housing (1) is sufficient to wholly accommodate a lock barrel (7) which extends from a front face of the housing (1). The handle (3) is generally "D"-shaped and wherein there is a greater distance behind the handle to the bottom of the planar base (5) at a central region (45) of the handle (3) than at the outer end regions (49) of the handle (3). The combination is formed of plastics material and lock security is enhanced by providing a metal base (5) to which a lock catch member (67) is attached, and a generally "L"-shaped cross-section metal cover which has one leg extending over a leading face (23) of the housing (1) and through which the locking tongue (11) of the lock catch member (67) passes, and where the other leg extends over a front face of the housing (1) to incorporate a front face of the lock barrel (7).

11 Claims, 3 Drawing Sheets

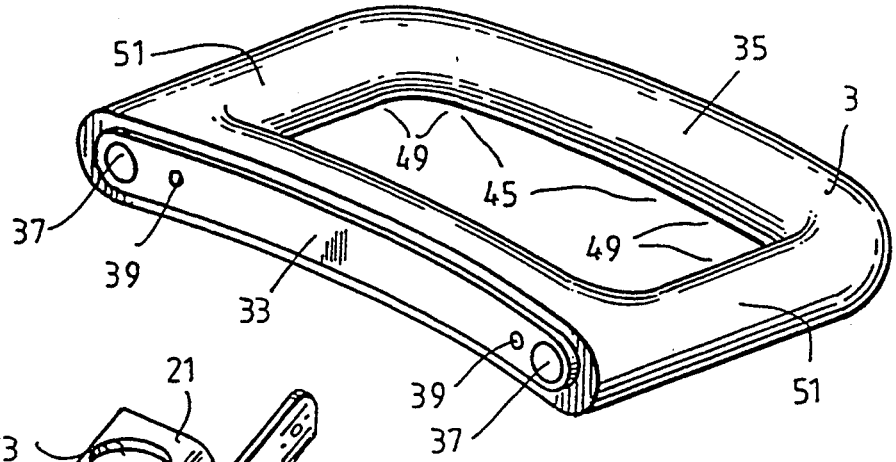
FIG. 11.
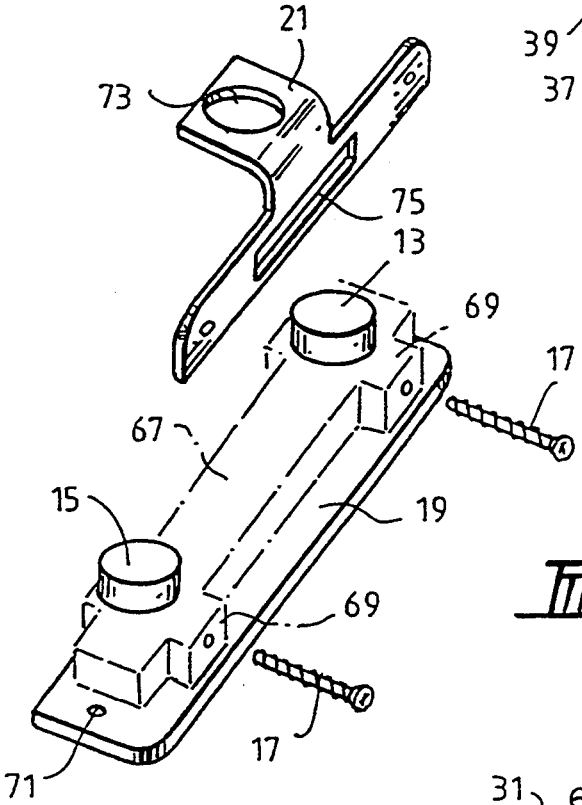
FIG. 13.
FIG. 12.
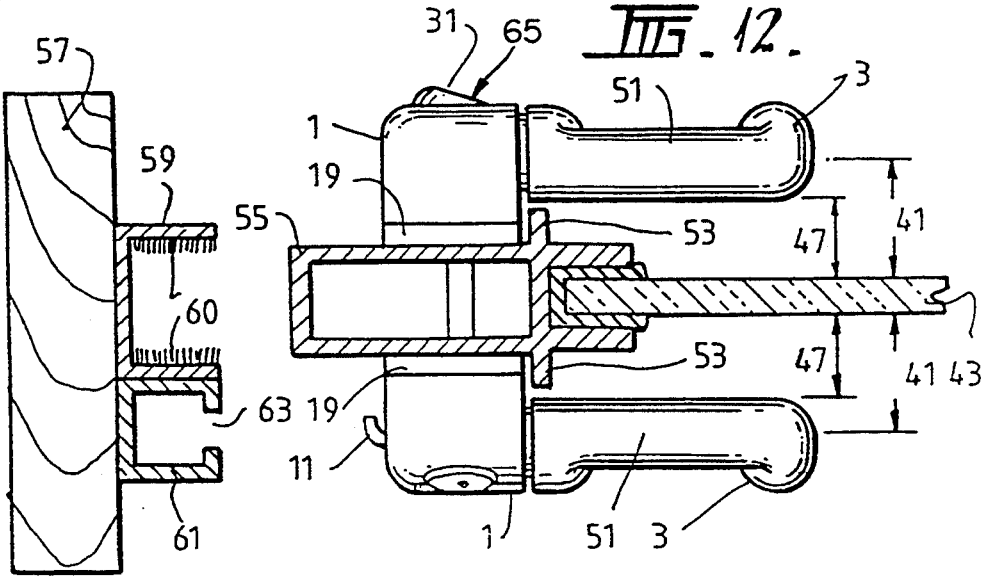

DOOR HANDLE WITH LOCK HOUSING

FIELD OF THE INVENTION

This invention relates to a sliding door or window, door handle and lock body combination and relates particularly but not exclusively to such for use on aluminium sliding doors or windows.

DESCRIPTION OF PRIOR ART

Hitherto it has been known to provide sliding door or window, door handle and lock body combinations. These have had a body part which wholly receives a lock barrel within the body and wherein a handle extends from the body. In the art of providing locks for sliding doors or windows of the above type, there is a particular requirement that the lock barrel be housed within the housing externally of the frame of the door or window, as otherwise mounting can be unnecessarily complicated. This, in turn, has particular problems because the housing must have a depth sufficient to accommodate the lock barrel and this, in turn, means that a handle which connects to the housing protrudes considerably from the front face of the door or window, as it extends from the outer face of the housing and must, in turn, provide sufficient clearance for a person's hand to grasp the handle thereof.

A further problem with the known sliding door or window, door handle and lock body combinations is that they are not particularly secure. The housings are usually mounted to the door or window by screws which are exposed on the front face of the housing. Thus, when the door or window is locked the screws are easily accessible. A further problem is that the known door handle and lock body combinations have not been particularly aesthetically pleasing.

OBJECT AND STATEMENT OF THE INVENTION

It is an object of the present invention to attempt to overcome one or more of the aforementioned problems.

In accordance with a first broad aspect of the present invention there is provided a door handle and lock body housing combination comprising a hollow lock body housing of generally elongate rectangular planar base configuration having a length approximately equal to the length of a handle which extends therefrom in a direction generally parallel with the planar base, the height and width of the hollow lock body housing being sufficient to wholly accommodate a lock barrel which extends from a front face of the housing disposed opposite the planar base, and wherein at least the handle is shaped so there is a greater distance behind the handle to the bottom of the planar base at a central region of the hand gripping portion of the handle than at the outer end regions of the hand gripping portion of the handle.

Most preferably, the handle has a generally "D"-shape with the straight legs thereof extending along the length of the hollow lock body housing and wherein the curved leg thereof forms a hand gripping portion of said handle.

According to a further broad aspect of the present invention there is provided a sliding door or window, door handle and lock body housing combination comprising a hollow lock body housing of generally elongate rectangular planar base configuration having a length approximately equal to the length of a handle which extends therefrom in a direction generally parallel with the planar base, the height and width of the hollow lock body housing being sufficient to wholly accommodate a lock barrel which extends from a front face of the housing disposed opposite the planar base, the combination being formed of a plastics material, and wherein lock security therefor is enhanced by providing a metal base to which a lock catch member is operatively attached, and a generally "L"-shaped cross-section metal cover which has one leg extending over a leading locking face of the hollow lock body housing and through which a locking tongue of the lock catch member passes and which has the other leg extending over a front face of the hollow lock body to incorporate a front face of the lock barrel.

Most preferably, the base is separate from the "L"-shaped cross-section cover although a one piece base and "L"-shaped cross-section cover is contemplated.

It is particularly preferred that the hollow lock body housing is mounted to the base by screw means which pass from the leading locking face of the hollow lock body housing. This ensures that the screws will be rendered tamper-proof when a door fitted with the combination is locked therewith by the screws being concealed by a housing on a non-moveable part of the frame on which the door or window slides and which housing receives the lock tongue of the lock catch member.

BRIEF DESCRIPTION OF DRAWINGS

In order that the invention can be more clearly ascertained an example of the preferred embodiments will now be described with reference to the accompanying drawings wherein:

FIG. 11 is a perspective view of a handle;

FIG. 12 is a transverse cross-sectional view showing the handles of FIGS. 1 through 5, and FIGS. 6 through 10, fitted to a sliding window or door.

FIG. 13 is an exploded perspective view of base and an "L"-shaped cover.

DETAILED DESCRIPTION OF PREFERRED EMBODIMENTS

Figure 1:
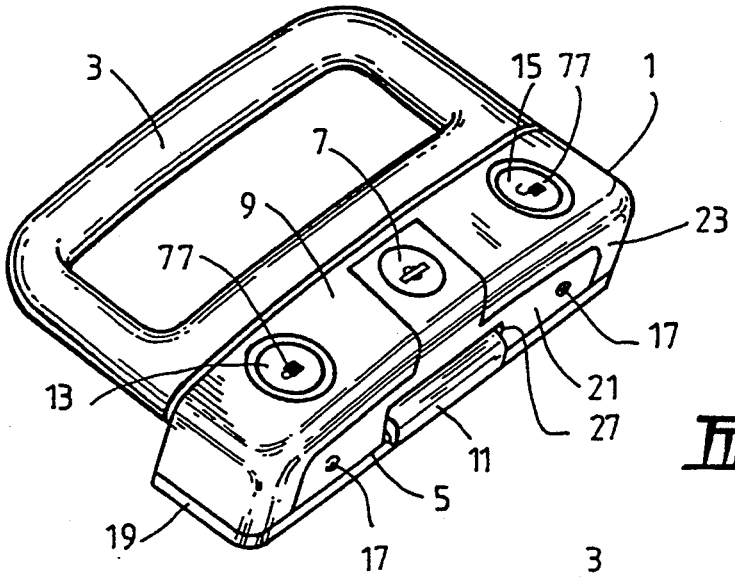
FIG. 1 is a front perspective view of a handle and lock body housing combination which can be fitted to the inside face of a sliding window or door.
Figures 2, 3, 4:
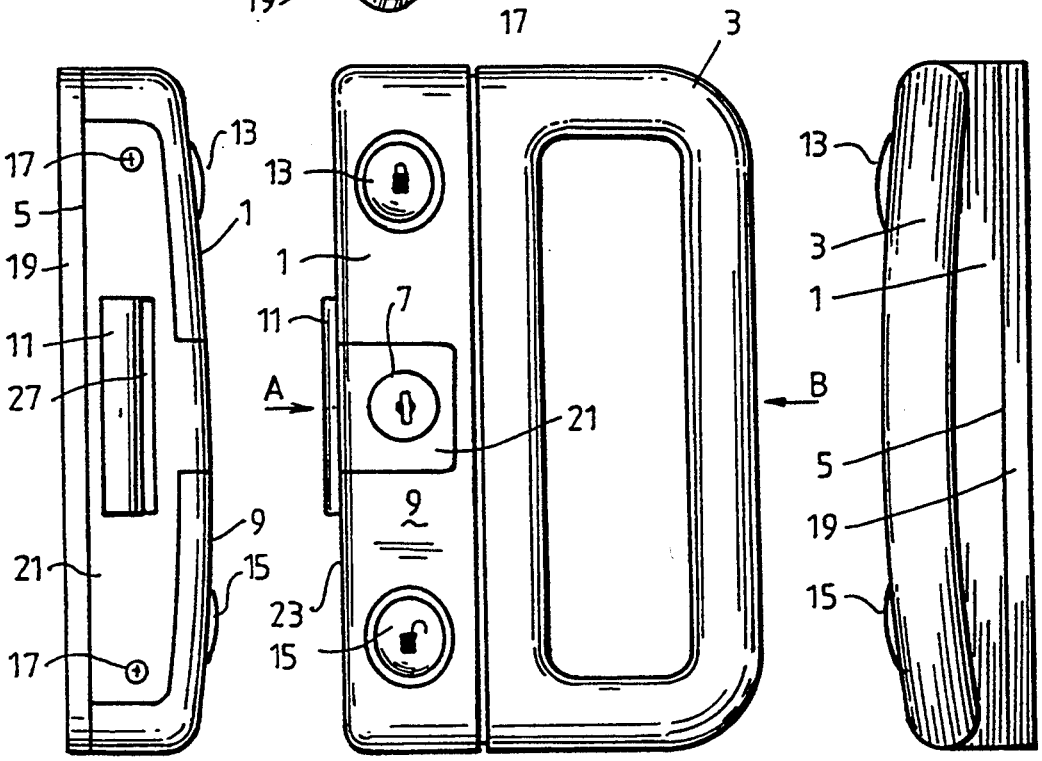
FIG. 2 is a front view of the combination shown in FIG. 1.
FIG. 3 is an end view taken in the direction of arrow A on FIG. 2.
FIG. 4 is an end view taken in the direction of arrow B on FIG. 2.

Referring now to FIGS. 1 through 5 there is shown a door handle and lock body housing combination for the inside face of a sliding door or window. Here the combination has a hollow lock body housing 1 and a generally "D"-shaped handle 3. The hollow lock body housing 1 is preferably made from a synthetic plastics material and has a generally planar base configuration 5 in the form of an elongate rectangle. The length of the housing 1 is approximately equal to the length of the handle 3 and it can be seen that the handle 3 extends from the housing 1 generally parallel with the planar base configuration 5. The housing 1 has a height and width sufficient to wholly accommodate a known lock barrel 7, the front face of which is shown in FIGS. 1 and 2. Thus, the lock barrel 7 extends internally from a front face 9 of the housing 1 to the planar base configuration 5.

The lock barrel 7 cooperates with a locking member (not shown in FIGS. 1 through 5) so that a locking tongue 11 can be raised or lowered relative to the planar base configuration 5. This, in turn, allows for locking engagement with a locking housing to be described later.

The housing 1 has push buttons 13 and 15 which cooperate with the locking mechanism to lock or release the lock so that the locking tongue 11 can be suitably operated. The lock barrel 7 is also arranged to cooperate with the locking mechanism to permit keyed locking of the locking tongue 11.

The handle 3 is preferably manufactured from a synthetics plastics material and is held to the housing 1 by screw means 17 (see FIG. 1) which pass through the hollow housing 1 and into screw fastening regions in the handle 3. This will be explained in greater detail in due course.

The hollow body housing 1 is mounted directly over a rectangular shaped metal base 19. The base 19 may be arranged to be exposed as shown or, alternatively, may be received wholly within the hollow housing 1.

Figure 5:
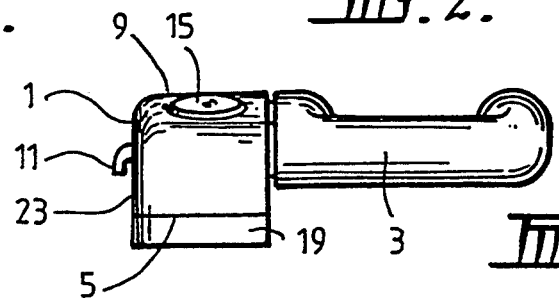
FIG. 5 is a side view.
Figure 6:
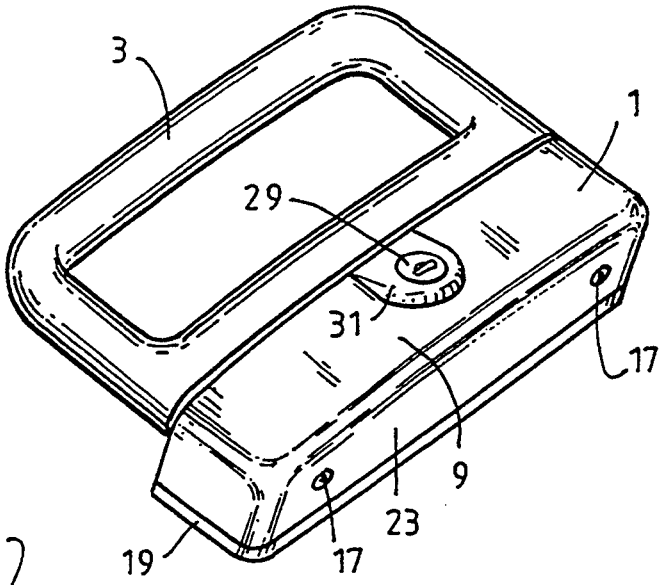
FIG. 6 is a perspective view of a handle and lock body housing combination which can be fitted to the external face of a sliding window or door.
Figure 8:
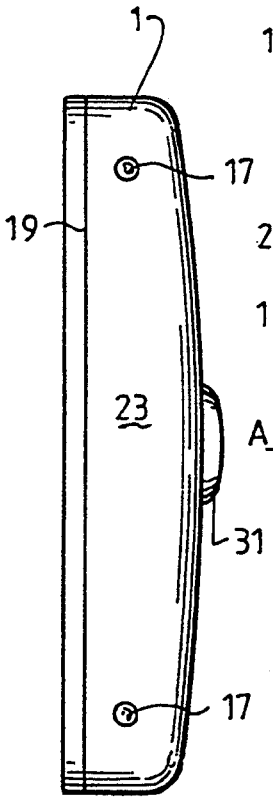
FIG. 8 is an end view in the direction of arrow A in FIG. 7.
Figure 7:
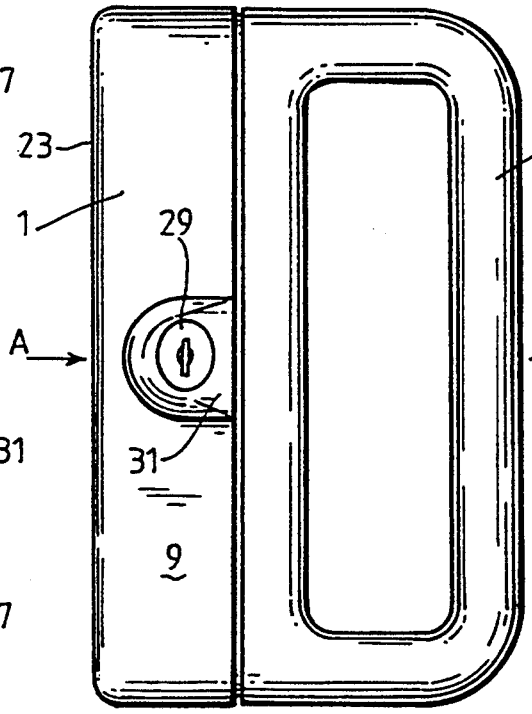
FIG. 7 is a front view of the combination shown in FIG. 6.
Figure 9:
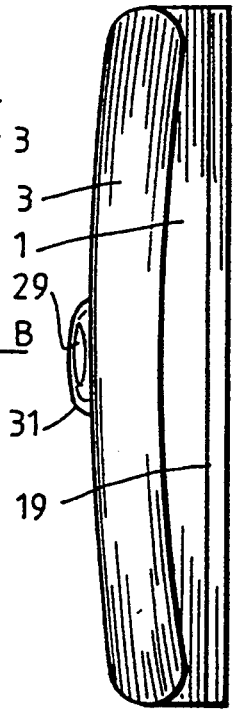
FIG. 9 is an end view in the direction of arrow B in FIG. 7.
Figure 10:
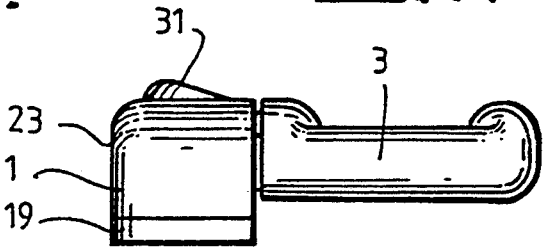
FIG. 10 is a side view.

An "L"-shaped cross-section cover 21 is arranged to be exposed and smoothly terminating with the leading face 23 and front face 9 of the housing 1 (see FIG. 5). The cover 21 is made of a metal so as to give the appearance of security to the assembly. Thus, the cover 21 has one leg forming part of a leading locking face 23 of the housing 1 and has the other leg forming part of front face 9 of the housing 1. The locking tongue 11 forms through a cut-out 27 in the leg which extends the leading locking face 23. Accordingly, the cover 21 encompasses the outer face of the lock barrel 7 and provides an appearance to the assembly of security even though the housing 1 and the handle 3 are of a synthetic plastics material.

Referring now to FIGS. 6 through 10 there is shown the sliding door or window door handle and lock body housing combination for fitting to the external or outer face of the sliding door or window. Like components to those in FIGS. 1 through 5 have been provided with identical numerical designations. The door handle and lock body housing combination is slightly different than that shown in FIGS. 1 through 5 in that there is no lock tongue 11 of a locking mechanism. Instead, the housing 1 carries a lock barrel 29 which may be similarly keyed to the lock barrel 7. The front face 9 may have a raised inclined portion 31 which is inclined in a direction away from the leading face 23. Thus, the front face of the lock barrel 29 can be inclined at the same angle as the angle of inclination of the portion 31. The purpose of this will be explained in due course. The front face of the portion 31 may have a metal escutcheon plate (not shown) embedded therein to assist in providing for enhanced security and enhanced security appearance of the assembly. Thus, it can be seen that the lock barrel 29 is also wholly received within the hollow body 1.

The lock barrel 29 is operatively interconnected with the locking mechanism housed within the housing 1 shown in FIGS. 1 through 5.

The housing 1 may be retained to the base 19 by means of screw means 17 as for the embodiments shown in FIGS. 1 through 5.

Referring now to FIG. 11 there is shown one preferred form of handle 3 which is molded separately from the housing 1. The handle 3 has a generally "D"-shape with leg 33 of the "D" interconnecting with a curved leg 35 of the "D". The handle is preferably molded hollow as seen by the hollow recesses 37. The molding includes screw-fastening recess means 39 to permit the screws 17 to locate therein and firmly hold the handle relative to the housing 1 and the base 19 as will be described hereinafter.

By inspecting FIGS. 1 through 11 it can be seen that the handle 3 is shaped so there is a greater distance behind the handle to the bottom of the planar base at a central region 45 of a hand gripping portion of the handle than at the outer regions 49 of the hand gripping portions of the handle. This can be seen clearly by inspecting FIG. 12. Here, there is a distance 41 behind the handle to the surface of a sliding window or door 43. This distance 41 extends from a central region 45 of the handle (see FIG. 11) towards the bottom of the planar base 19. This distance is greater than the corresponding distance 47 which extends from the outer end regions 49 of the handle 3.

Preferably the hand gripping portion of the handle 3 is arcuately curved as shown. The arrangement is such that the return legs 51 of the handle 3 can be mounted to the housing 1 at a position very close to the planar base configuration 5 of the housing 1 which, in turn, is close to the base 19. The positioning is such that the return legs 51 pass over the top of strengthening flanges 53 forming part of the metal frame 55 of the door or window and as close as possible thereto. It should be noted that the distance 47 is insufficient to enable easy placement of a person's fingers around the handle 3 whereas at the central region 45 of the handle 3 there is considerably greater distance as shown by distance 41 which is sufficient to permit relatively easy gripping of the handle 3 by a user.

FIG. 12 shows how the door or window can slide in a door or window frame 57 and be received within a "U"-shaped frame part 59. Thus, the leading side of frame 55 locates within the "U"-shaped frame part 59 and engages with known sealing means 60 to effect a tight weather seal.

The locking tongue 11 can locate within a locking housing 61 fastened to the frame 57 or the frame part 59. In this case, a slot 63 is provided in the locking housing 61 and a lip of the locking tongue 11 locates through the slot 63 and over one of the shoulders around the slot 63. The housing 61 can be made to have the same length as the length of the housing 1 if required. The exact shape and construction of the locking housing 61 is immaterial to the present invention.

FIG. 12 also shows that for the handle and lock body housing combination fitted externally of the door that the inclined face of the portion 31 will receive a key in the direction of the arrow 65. Thus, the key can enter the lock barrel relatively easily and without fear of a person's fingers engaging with the frame 57 or the frame part 59, relative to that if the face were parallel with the sliding direction of the door or window.

Referring now to FIG. 13 there is shown a base part 19 with the push buttons 13 and 15 interconnected with a locking mechanism shown generally by numeral 67. One such locking mechanism can be obtained from Messrs. Alchin and Long Group Pry. Ltd. trading as Doric Products located at 1b McBeth Street, Braeside, Victoria, Australia. The lock mechanism per se forms no part of the present invention. It should be noted that the lock mechanism 67 includes outwardly directed portions 69 which contain apertures through which screws 17 can pass. Thus, the outermost faces of the portion 69 corresponds with the internal width of the hollow housing 1. Thus, the hollow housing 1 can be fitted to the base 19 and secured thereto by the screws 17 passing through the apertures and locating in the screw fastening recess means 39 in the handle 3, thereby holding the handle 3 and the housing 1 fixed relative to the base 19. The base 19, in turn, has apertures 71 through which screws can be passed to hold the base 19 relative to the frame 55.

The "L"-shaped cover 21 is fitted relative to the housing 1 prior to insertion of the screws 17. It can be seen that the cover 21 contains an aperture 73 and a slot 75 for receipt respectively of the front face of the lock barrel 7 and the locking tongue 11.

With the construction shown, the handle 3 is held as close as possible to the frame 55 while permitting a central region 45 to have sufficient height to enable a person's fingers to easily grip the handle 3.

The push buttons 13 and 15 may have suitable indicia 77 thereon (see FIG. 1) representing a locked or unlocked condition of the locking mechanism. Thus, one of the indicia may be that of a locked padlock while the other may be of an unlocked padlock.

The arrangement shown is such that the curvature of the handle 3 follows through onto the body 1 so that the body 1 has an upper front face 9 which has a similar curvature. Thus the arrangement is such that the handle 3 and/or the body 1 is unlikely to catch in curtain material or with a person's clothes. Thus, not only has an aesthetically pleasing handle and housing combination been provided but one which is structurally as strong as possible, given the constraints of the limited space required for the handle 3 and the requirement for providing sufficient room for a person's fingers to grip the handle 3, plus the requirement that the handle 3 should not extend unduly from the front face of the frame 55 since it often is necessary to fit a fly-wire door or like screen to the window or door, and space is therefore limited.

Modifications may be made to the present invention as would be apparent to persons skilled in the door locking and/or handle arts. These and other modifications are deemed to be within the ambit of the invention, the nature of which is to be determined from the foregoing description.

We claim:

1. A door handle and lock body housing combination, comprising a hollow lock body housing attached to an elongate planar base, said lock body housing and said base having a length approximately equal to the length of a handle which extends from the lock body housing in a direction generally parallel with the planar base, the height and width of the hollow lock body housing being sufficient to wholly accommodate a lock barrel which extends internally from a front face of the hollow lock body housing, said handle having a hand gripping portion comprised of a central region and outer end regions on either side of said central region, and wherein at least the handle is shaped so there is a greater distance behind the handle to the bottom of the planar base at the central region of the hand gripping portion of the handle than at the outer end regions of the hand gripping portion of the handle.

2. The combination as claimed in claim 1, wherein the handle is generally "D"-shaped and comprised of a generally straight leg extending along the length of the hollow lock body housing and a curved leg which forms said hand gripping portion of said handle, said curved leg including return leg portions connected to said generally straight leg.

3. The combination of claim 1, wherein an exposed face of said lock barrel is inclined relative to said elongate planar base, so that a key for said lock barrel is insertable at an angle relative to a perpendicular to said planar base to assist in easy insertion.

4. The combination as claimed in claim 1, wherein the handle is separate from said hollow lock body housing and is attachable thereto.

5. The combination as claimed in claim 1, wherein said base is formed of metal and said lock body housing and handle are formed of a plastics material, and further including a generally L-shaped metal cover having one leg forming part of a locking face of the hollow lock body housing and a second leg forming part of said front face of the hollow lock body housing to receive a front face of said lock barrel, said one leg of said metal cover being formed with an elongated slot, and a lock catch member having a locking tongue extending through said slot and outwardly of said lock body housing.

6. The combination as claimed in claim 1, wherein said combination is mounted on one face of a frame of a sliding door or window, and wherein a similar combination is mounted on an opposite face of the sliding door or window, and wherein a lock barrel is mounted in each of said combinations so that said door or window can be locked or unlocked by operation of the lock barrel of either combination.

7. The combination as claimed in claim 6, further including two push buttons extending through the front face of the lock body housing of the combination which is mounted on the face of the frame of the sliding door or window which is to be internal of a building in which the sliding door or window is fitted and wherein one push button is for locking and the other for unlocking.

8. The combination as claimed in claim 7, wherein the push button for locking is provided with indicia to signify locking, and the push button for unlocking is provided with indicia to signify unlocking.

9. A sliding door or window, handle and lock body housing combination, comprising a hollow lock body housing attached to an elongate planar base, said lock body housing having a front face and a locking face, said lock body housing and said base having a length approximately equal to the length of a handle which extends from the lock body housing in a direction generally parallel with the planar base, the height and width of the hollow lock body housing being sufficient to wholly accommodate a lock barrel which extends internally from said front face of said lock body housing, said base being formed of metal and said lock body housing and said handle being formed of a plastics material, a lock catch member operatively attached to said base, and a generally L-shaped metal cover having one leg forming part of said locking face of said lock body housing and a second leg forming part of said front face of said hollow lock body housing, said second leg having an opening incorporating a front face of said lock barrel, said one leg of said metal cover being formed with an elongated slot, and said lock catch member having a locking tongue extending through said slot and outwardly of said lock body housing.

10. The combination as claimed in claim 9, wherein said base is separate from said L-shaped cover.

11. The combination as claimed in claim 9, wherein said hollow lock body housing is mounted to said base by screw means which pass through openings in said one leg of said cover and into threaded engagement with openings formed in said handle for securing said cover and said lock body housing to said base.

* * * * *